US006079066A

United States Patent [19]

Backlund

[11] Patent Number: 6,079,066

[45] Date of Patent: Jun. 27, 2000

[54] PILLOW

[75] Inventor: Ola Backlund, Ornsköldsvik, Sweden

[73] Assignee: JB Prominens AB, Ornskoldsvik, Sweden

[21] Appl. No.: 09/214,821

[22] PCT Filed: Jul. 11, 1997

[86] PCT No.: PCT/SE97/01266

§ 371 Date: Mar. 2, 1999

§ 102(e) Date: Mar. 2, 1999

[87] PCT Pub. No.: WO98/02071

PCT Pub. Date: Jan. 22, 1998

[30] Foreign Application Priority Data

Jul. 12, 1996 [SE] Sweden ..... 9602764

[51] Int. Cl.[7] ..... A47G 9/00

[52] U.S. Cl. ..... 5/636; 5/643

[58] Field of Search ..... 5/636–639, 643; D6/601

[56] References Cited

U.S. PATENT DOCUMENTS

| | | | |
|---|---|---|---|
| D. 316,353 | 4/1991 | Dobson | D6/601 |
| D. 407,256 | 3/1999 | Backlund | D6/601 |
| 2,940,087 | 6/1960 | Kieffer | 5/643 |
| 4,218,792 | 8/1980 | Kogan | 5/636 |
| 4,748,702 | 6/1988 | Sandler | 5/643 |
| 5,533,218 | 7/1996 | Fahy | 5/636 |
| 5,644,809 | 7/1997 | Olson | 5/636 |
| 5,682,633 | 11/1997 | Davis | 5/636 |

*Primary Examiner*—Alexander Grosz
*Attorney, Agent, or Firm*—John Lezdey & Assoc

[57] ABSTRACT

A pillow is provided made of resilient material and including a top side and bottom side which delimit a head section for supporting a user's head. The pillow has at least one elongated neck section adjoined to the head section wherein the upper side of the neck section is higher than the head section. The pillow is also provided with a resilient material having a channel.

7 Claims, 2 Drawing Sheets

PILLOW

The present invention relates to a pillow made of resilient material and comprising an upper side and a lower side which delimit a head section for supporting the head of the user and at least one elongated neck section adjoining said head section, wherewith the upper side of the neck section is higher than the head section such as to provide support for the neck and throat of the user.

BACKGROUND OF THE INVENTION

Such a pillow, which can also be called a cervical pillow, provides the user with a more comfortable sleeping or resting position, by providing support for the neck and throat of the user, so that the user's head will not be angled unnaturally in relation to the user's body when in a resting position. The core of such a pillow, which may made of polyurethane foam, needs to be relatively solid and compression rigid, in order to retain its anatomical shape and fulfil its supportive function when subjected to the weight of the user's head and throat/neck parts. However, there is a risk of soft tissue, particularly the soft tissue of the neck/throat, being subjected to an excessively high pressure, or of the cervical vertebrae being subjected to excessively large shear forces, especially when the user lies on his/her stomach or back. Although the neck section of the pillow will have a greater spring length because of its height and can therefore be made more resilient or springy than the head section and therewith feel softer, this has not been found sufficient to compensate for the necessary hardness or firmness of the pillow core. These mutually contradictory requirements with regard to shape-rigidity and softness have not been resolved satisfactorily hitherto.

A person sleeping or resting on his/her side will normally also require a firmer or higher support against his/her head and neck and will therefore often use a hand, a lower arm or an upper arm to obtain a natural, firmer support or a higher support, so as to rest more comfortably. Known neck pillows normally have a constant height and constant lateral firmness, with the result that such pillows are too hard or solid against the user's neck when the user lies on his/her back. Furthermore, such pillows press much too hard against the user's throat when he/she lies on his/her stomach, and subjects the cervical vertebra to an ergonomically negative, backwardly bent and rotated outer position.

Seen against this background, an object of the present invention is to provide a neck pillow of the kind defined in the introduction which is more correct anatomically and more user-comfortable than known neck pillows, and which will adopt an anatomically neutral position both when the user lies on his/her back or on his/her side, and reduce the outer position when the user lies on his/her stomach.

Because there is formed in the resilient material of the core a cavity or aperture that extends transversely across the centre of the neck section and opens out through one side of said neck section, there is obtained in a surprisingly simple and material-saving fashion a pillow that includes a locally softer supporting part, primarily for supporting the user's head, neck and throat when the user lies on his/her back or stomach. There is thus achieved simultaneously the desired variation in firmness in a lateral direction or along the length of the neck section, so as to achieve the desired softer support against neck or throat when the user lies on his/her back or stomach, by virtue of the cavity being positioned centrally of the neck section.

When the cavity or aperture has the form of a channel that extends transversely across the neck and head section of the pillow, the variation in firmness, or hardness, extends along the length and up to the head section. The head section may normally need to be somewhat firmer than the neck section, and consequently that part of the channel which extends transversely to the head section will preferably have a smaller cross-sectional area than that part of the channel which extends transversely to the neck section. The smaller cross-section can be obtained by narrowing the channel in the head section. Alternatively, the smaller cross-section can be obtained beneficially by gradually decreasing the height of the channel with increasing distance from the channel orifice at the neck section; this is particularly advantageous when the head section slopes slightly from a higher to a lower side of the pillow, in that this sloping of the main section is compensated for by corresponding sloping of the "roof" of the channel. In one preferred embodiment, the channel has a generally arcuate or semi-elliptical cross-sectional shape.

These and other features of the invention will be apparent from dependent Claims and from the following detailed description made with reference to exemplifing embodiments thereof and also with reference to the accompanying drawings.

Figure 1:
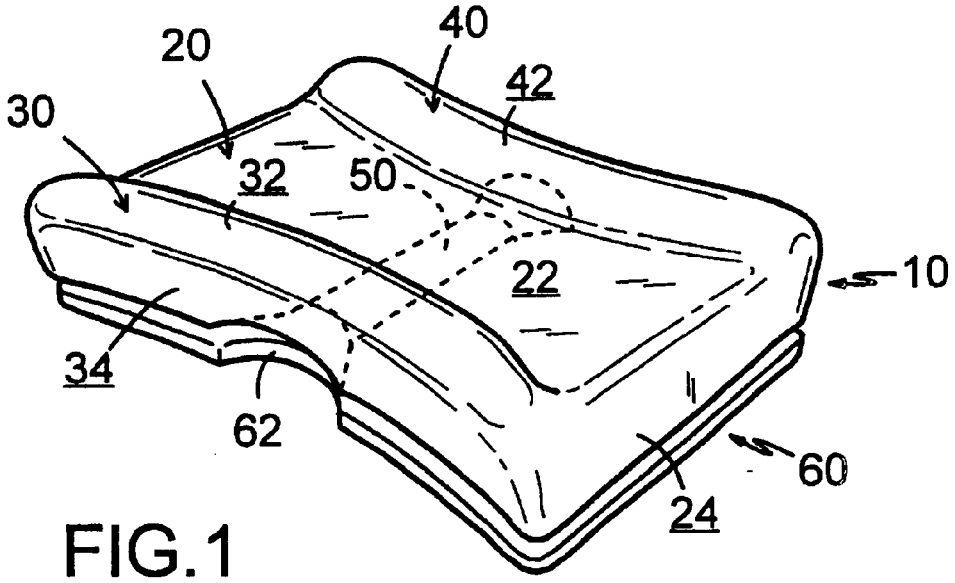
FIG. 1 illustrates in perspective and obliquely from above one embodiment of an inventive pill that includes a bottom plate.

The inventive pillows shown in the various Figures and identified by the general reference numeral 10 are actually pillow cores that are preferably made of an homogenous resilient material, such as polyurethane foam. When the pillow cores are sold as pillows, they will normally have a textile covering, not shown in the drawings. The term pillow as used in the following description also includes the pillow core.

An inventive pillow 10 can be considered to consist typically of a head section 20 and at least one neck or throat section 30, 40 formed integrally with the head section 20 at one end thereof. Although the inventive scope allows the pillow 10 to include only one neck section, the illustrated pillow includes two mutually opposite neck sections 30 and 40.

The lower head section, which is intended to support the user's head, has a generally flat and slightly sloping upper surface 22, whereas the higher, elongated neck sections 30, 40 intended for supporting the user's throat or neck, preferably have flat upper surfaces 32, 42 which narrow at the ends and which have rounded edges. In the illustrated embodiments, the neck sections 30, 40 are also curved in the general shape of a banana, or swung inwardly towards the center of the pillow 10 and have downwardly and inwardly sloping outer surfaces 34, 44 so as to provide more space for the user's shoulder when lying on his/her side. The height of the neck sections may also decrease in a direction towards the narrowing ends of said sections, as indicated at the higher end of the neck section 30 in FIG. 1. The two remaining, opposite outer sides 24, 26 of the pillow 10 are generally flat.

In order to enable one and the same pillow 10 to be used by persons of varying body structure, and to also satisfy the varying preferences of users to lie in different positions or at different times and also to enable the pillow to be used throughout the growth period of a person, the neck sections 30, 40 are given different heights and the pillow 10 is provided with a separate bottom plate 60 to these ends. The height of respective neck sections 30, 40 and the thickness of the bottom plate 60 are adapted to enable the pillow to provide four different heights for supporting the user's neck or throat, depending on whether the bottom plate is used or not and depending on which of the two neck sections is used.

The underside of the inventive pillow 10 is provided with a cavity 50 in the resilient material, this cavity being adapted to provide in the neck pillow a supporting region whose supporting effect is reduced in relation to the remainder of the supportive region of the pillow. In the illustrated embodiments, the cavity extends in the form of a channel through the entire pillow 10, but may be formed in many different ways within the scope of the following Claims. For instance, the cavity need not be a through-penetrating cavity and may also have a closed cross-section contour (not shown). The cavity may also be filled with material that is softer than the resilient material (not shown) from which the pillow is made.

The cavity enables the aforedescribed relatively stiff or firm resilient material to be made locally much softer with regard to the weight of the user's neck and head on the upper side of the pillow, by forming in the material an arch which forces the material to be flexed downwards under said weight and not only compressed thereby.

Figure 2:
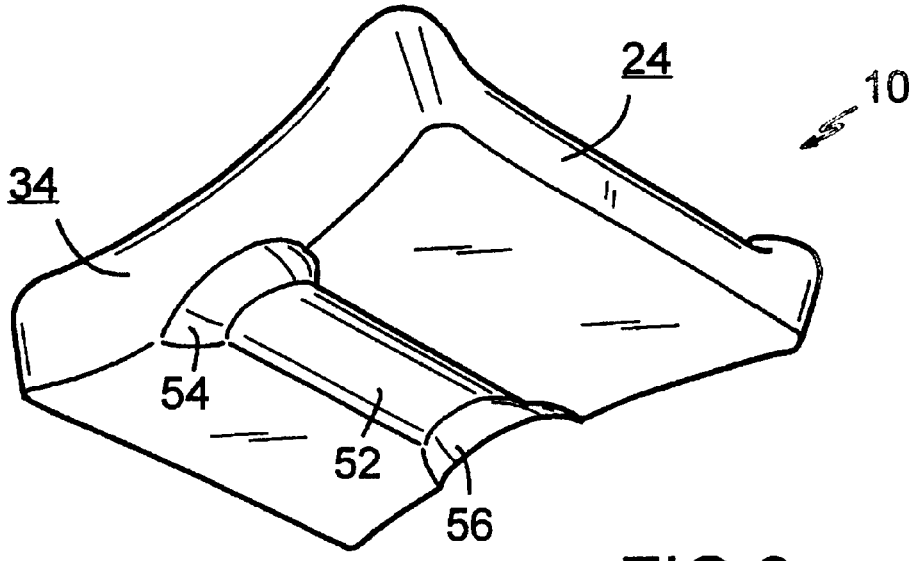
FIG. 2 is a perspective view of the inventive pillow seen obliquely from beneath and without the bottom plate.
Figure 3:
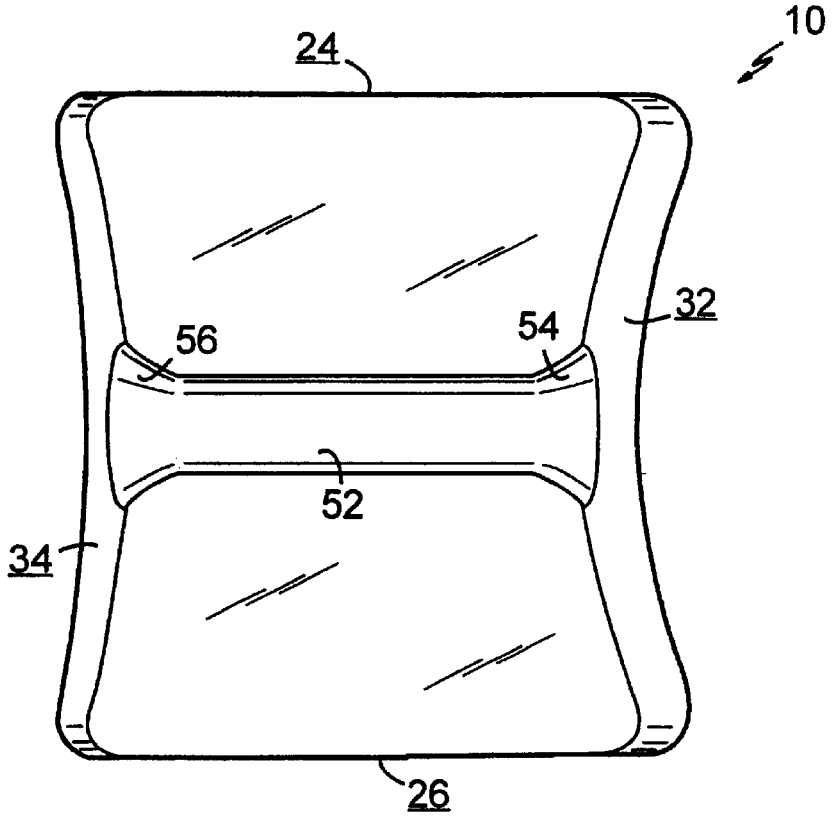
FIG 3 is a bottom view of a pillow.

In the embodiment illustrated in FIGS. 1 and 2, the through-penetrating channel 50 includes, on the one hand, a head-part 52 which is located beneath the head-section 20 of the pillow and which has a constant, part-cylindrical, e.g., arcuate or semi-elliptical, cross-sectional shape, and, on the other hand, an end-part 54, 56 which is located beneath the neck sections 30, 40 of the pillow and which has roughly a funnel-like, outwardly flared cross-sectional shape. By varying the cross-sectional area of the channel 50 in this way, the firmness of the pillow is also varied in a direction commensurate with the user's neck-head, such that in this case the neck section 30, 40 will be afforded a greater increase in softness than the head section 20. As evident from FIG. 1, the bottom plate 60 may be provided with a recess 62 in the region of both ends 54, 56 of the channel 50 (only one such recess being shown). This will enable the underside of the center region of the neck sections 30, 40 to bend downwards beyond the upper side of the bottom plate 60.

Figure 4:
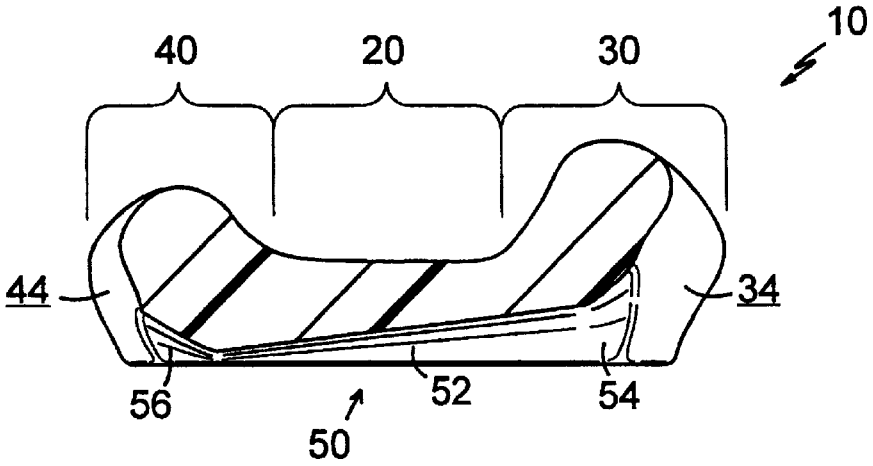
FIG. 4 is a cross-sectional view corresponding to the view of FIG. 3 and illustrates an inventive pillow that includes a channel of varying height.

FIG. 4 shows by way of example how the cross-sectional area of the channel 50 can be varied so as to vary the firmness of the pillow continuously in the direction of the user's neck-head. In this case, the end-parts 54, 56 of the channel 50 are roughly funnel-shaped, whereas the head-part 52 of the channel 50 has a constant width but decreases linearly in height in said neck-head direction, towards the low side of the pillow. When the cross-sectional shape is generally semi-elliptical, the major axis of the ellipse is constant, whereas the minor axis of the ellipse varies linearly through the head part 52 of the channel 50. The pillow shown in FIG. 4 thus has a generally, relatively softer and higher neck section 30, a relatively firmer, lower neck section 40 and a head section 20 of varying firmness.

Thus, in addition to the four possible positions of use mentioned in the foregoing, an inventive pillow can be used in a further four positions, namely with the neck or throat turned towards the softer supportive region of the high neck section 30 or the low neck section 40 produced by the aperture 50, and alternatively with or without the bottom plate 60. Naturally, the four earlier discussed user positions are achieved by the user moving his/her head and neck from the softer, central supportive region to one of the laterally located firmer supportive regions.

I claim:

1. In a pillow made of a resilient material and including a top side and a bottom side which delimit a head section for supporting a user's head, and at least one elongated neck section which adjoins the head section and the top side of which is higher than the head section so as to support the user's neck and throat, the improvement which comprises that the resilient material from which the pillow is made has formed therein a channel which extends transversely in the center of the neck section at said bottom and which has a length such that the pillow obtains a softer supportive part for at least the neck, the cervical vertebrae and the throat, and opens out through at least one side of the neck section such as to reduce pressure and shear forces on the cervical vertebrae and throat, primarily when the user lies down.

2. A pillow according to claim 1, wherein said channel has an end-part which widens in a direction towards said at least one side.

3. A pillow according to claim 1 which comprises said pillow having a higher and a lower neck section, and that the cross-sectional area of the channel decreases through the head section.

4. A pillow according to claim 1 wherein said channel has an arcuate cross-sectional shape.

5. A pillow according to claim 1 wherein said channel is delimited by the upper surface of a bottom plate intended for the pillow.

6. The pillow according claim 1 wherein said neck section comprises two sections of different height so as to provide for different heights to support the neck.

7. The pillow according to claim 1 including a bottom plate.

* * * * *